US006233853B1

(12) United States Patent
Buchmann

(10) Patent No.: US 6,233,853 B1
(45) Date of Patent: May 22, 2001

(54) STEAM IRONING STATION HAVING A DEVICE FOR INCREASING THE STEAM GENERATING POWER

(76) Inventor: Richard Buchmann, Frauenbergstrasse 14, D-73337 Bad Überkingen (DE)

( * ) Notice: Subject to any disclaimer, the term of this patent is extended or adjusted under 35 U.S.C. 154(b) by 0 days.

(21) Appl. No.: 09/358,825

(22) Filed: Jul. 22, 1999

(30) Foreign Application Priority Data

Jul. 22, 1998 (DE) ..... 298 13 063

(51) Int. Cl.[7] ..... D06F 75/40
(52) U.S. Cl. ..... 38/77.6; 219/255
(58) Field of Search ..... 38/77.6, 77.3, 38/77.7, 96; 219/247, 248, 252, 255, 250

(56) References Cited

U.S. PATENT DOCUMENTS 3,508,354 * 4/1970 Stansbury et al. ..... 38/77.6
5,042,179 * 8/1991 Van Der Meer ..... 38/7.8 X
5,191,191 * 3/1993 St. Aubyn ..... 219/485
5,780,812 * 7/1998 Klinkenberg ..... 38/77.6 X

* cited by examiner

*Primary Examiner*—Ismael Izaguirre
(74) *Attorney, Agent, or Firm*—Venable; Gabor J. Kelemen

(57) ABSTRACT

A steam ironing station includes a steam iron; a steam generator supplying steam to the steam iron; an iron heater disposed in the iron and having an iron heater circuit connectable to a line voltage; a temperature responsive device for opening the iron heater circuit when a predetermined ironing temperature is reached; and a steam generator heater disposed in the steam generator and having first and second steam heater circuits connectable to the line voltage. The electric power, supplied simultaneously by the iron heater circuit and by the first steam heater circuit to the steam ironing station has a maximum value of the rated power of the line voltage, and the electric power supplied solely by the second steam heater circuit to the steam ironing station has a maximum value of the rated power and a greater value than the power supplied by the first steam heater circuit. Further, a switching arrangement is provided for placing the second steam heater circuit in a closed state solely when the iron heater circuit is in an open state.

6 Claims, 2 Drawing Sheets

STEAM IRONING STATION HAVING A DEVICE FOR INCREASING THE STEAM GENERATING POWER

CROSS REFERENCE TO RELATED APPLICATION

This application claims the priority of German Utility Model Application No. 298 13 063.7 filed Jul. 22, 1998 which is incorporated herein by reference.

BACKGROUND OF THE INVENTION

This invention relates to an electrically heated steam ironing station composed of a steam iron and a steam generator which is heatable in at least two power stages and which is separate from the steam iron and is coupled thereto by a steam hose.

Steam ironing stations of the above type are widely known in many markets of the world. In some regions, however, such steam ironing stations which require substantial electric power since their steam output is at least twice that of manual steam irons which have a self-contained steam generator, are unknown for household use. The reason therefor resides in the low line voltage in countries of such regions. The available electric power at the line outlet is the product of the line voltage and the maximum current intensity. The maximum household current intensity is worldwide limited to approximately I=12A while the line voltage is in some countries only 100V. In such a network the maximum rated power at an outlet is thus limited to $P_{max}=V\times I=1200$ W. Considering that the heater for the electric iron needs a power of, for example $P_{BE}=800$ W, then for the steam generator only $P_{DE}=400$ W remains. With such a low power, however, no more vapor may be generated than in a manual steam iron having an integral steam generator. Consequently, under such circumstances installing conventional steam ironing stations capable of producing substantially more vapor power than a manual steam iron has no practical justification in regions providing only an about 100 V line voltage.

A high-power steam ironing station has a power rating of approximately P=2000 W. Thus, in accordance with the above calculation, for the steam generator about $P_{DE}=1200$ W power may be allocated which suffices for a steam supply of almost 30 g/sec. In case a higher steam output is desired, even regions with 220/230V line voltage experience the above-explained problem.

SUMMARY OF THE INVENTION

It is an object of the invention to provide an improved steam ironing station in which the power supplied for steam generation is increased without increasing the rated power supply of the network.

This object and others to become apparent as the specification progresses, are accomplished by the invention, according to which, briefly stated, the steam ironing station includes a steam iron; a steam generator supplying steam to the steam iron; an iron heater disposed in the iron and having an iron heater circuit connectable to a line voltage; a temperature responsive device for opening the iron heater circuit when a predetermined ironing temperature is reached; and a steam generator heater disposed in the steam generator and having first and second steam heater circuits connectable to the line voltage. The electric power, supplied simultaneously by the iron heater circuit and by the first steam heater circuit to the steam ironing station has a maximum value of the rated power of the line voltage, and the electric power supplied solely by the second steam heater circuit to the steam ironing station has a maximum value of the rated power and a greater value than the power supplied by the first steam heater circuit. Further, a switching arrangement is provided for placing the second steam heater circuit in a closed state solely when the iron heater circuit is in an open state.

DESCRIPTION OF THE PREFERRED EMBODIMENTS

According to the invention the steam output of the steam ironing station may be increased by 100% if used with a line voltage of about 100V or by 33% if used with a line voltage of about 200V. Such a power increase is effected by means of an electric circuit which, at any time when the heater thermostat of the iron has reached the desired temperature, cuts electricity to the heater and directs to the steam generator the power proportion reserved for the heater. Even if ironing is performed at the highest temperature stage, such a de-energized state of the iron prevails approximately 50% of the working period, so that the steam generator receives, on the average, an additional power of $P_{ZD}=400$ W. Since the heater thermostat is located in the iron, the information concerning the de-energized state of the heater needs to be transferred to the steam generator which is achieved by the arrangements illustrated in FIGS. 1–4.

Figure 1:
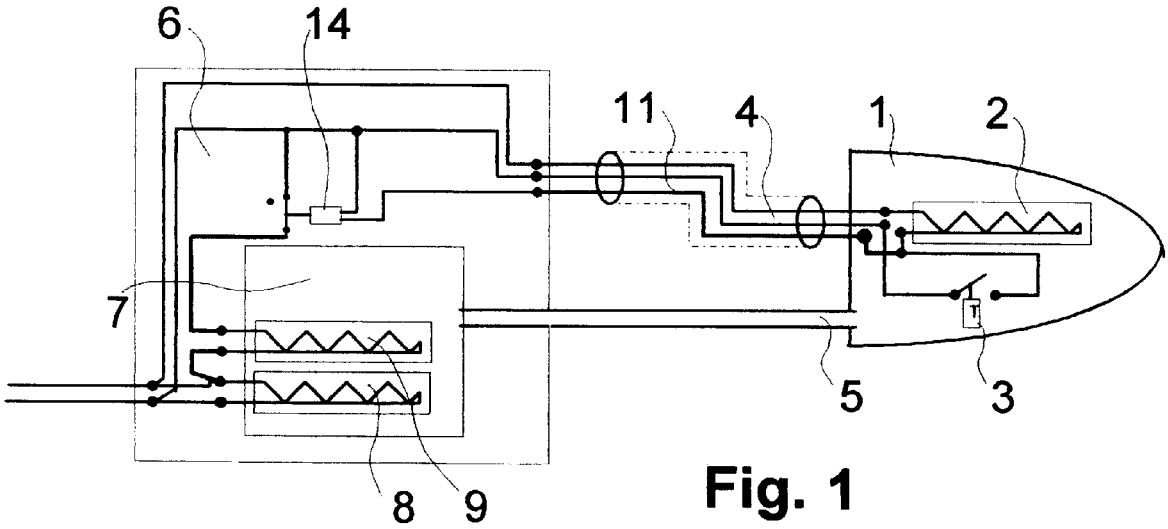
FIGS. 1–4 are circuit diagrams of four preferred embodiments of the invention.

Turning to FIG. 1, an iron 1 includes an electric heater 2, whose circuit is opened by a thermostat 3 upon reaching a predetermined temperature. The circuit is supplied with electric current by a mains cable 4 connected to line voltage. An additional conductor 11 extending parallel to the mains cable 4 is connected to the heater circuit between the heater 2 and the thermostat 3. The additional conductor 11 controls a relay 14 located in the housing 6 forming part of a steam generating unit separate from the iron 1. If the contacts of the thermostat 3 are closed, no current flows through the additional conductor 11, that is, the solenoid of the relay 14 is short-circuited, causing the contacts of the relay 14 to open. If, on the other hand, the contacts of the thermostat 3 are open, current flows through the additional conductor 11, that is, the relay 14 is energized by a current which flows through the circuit of the iron heater 2 and which is limited by the resistance of the relay solenoid. As a result, the relay is actuated, that is, its contacts close, whereby an additional steam heater 9 is energized with a power of, for example, $P_{ZD}=800$ or instead of the normal steam heater 8, another heater is energized which is associated with the steam generator 7 of the steam generating unit and which is rated for a power that is 800 greater than the normal iron heater.

Figure 2:
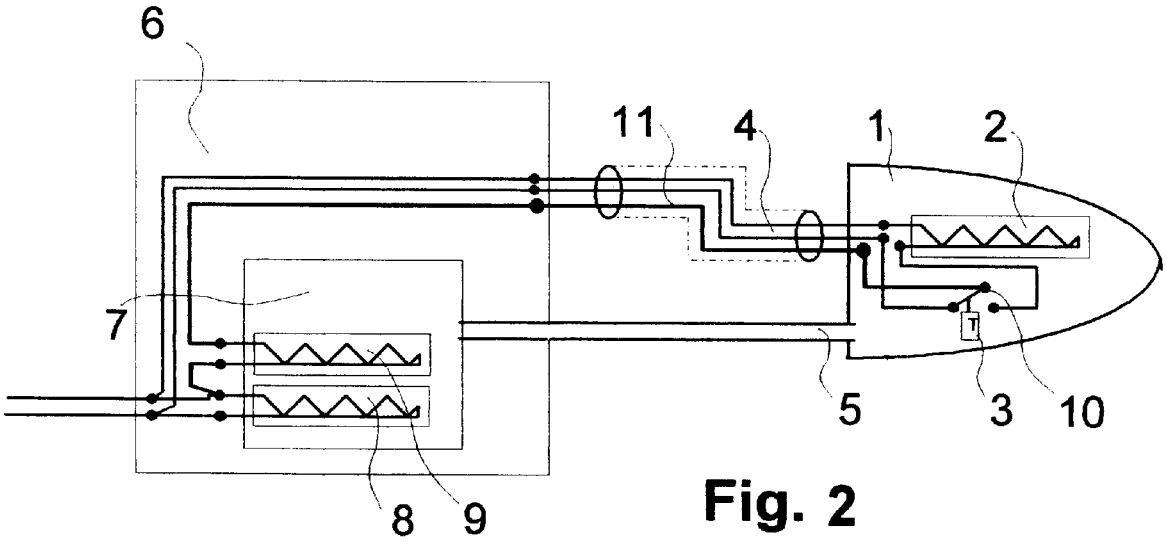

In the embodiment of FIG. 2 the additional conductor 11 controls the additional heater 9 directly, without the interposition of a relay. In such an arrangement the heater thermostat 3 is provided with an additional contact 10 connected to the additional conductor 11, whereby in the shown position the movable switch contact of the thermostat 3 closes the circuit of the additional heater 9 of the steam generator 7 and opens the circuit of the iron heater 2. In its alternate position the movable switch contact of the thermostat 3 opens the circuit of the additional heater 9 of the steam generator 7 and closes the circuit of the iron heater 2.

Figure 3:
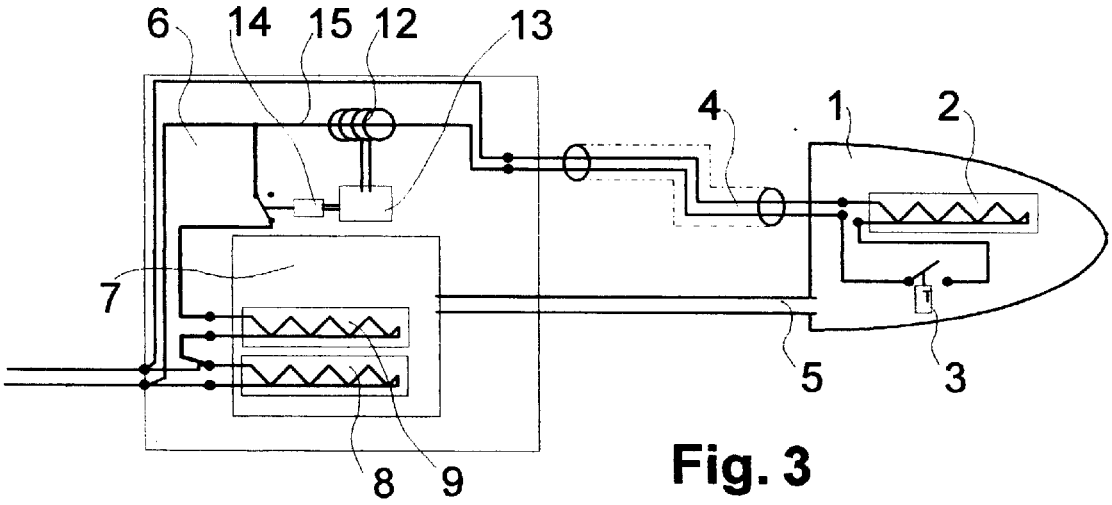

All the Figures show that normally the iron 1 is connected to the steam generating unit by the electric cable 4 and the steam hose 5. As shown in FIG. 3, it is also feasible to control the relay 14 by means of a sensor 12 located in the housing 6 of the steam generating unit. The sensor 12 detects the magnetic field of the supply current 15 of the iron heater 2 and a suitable electronic circuit 13 connected to the sensor 12 controls the relay 14. Expediently, commercially available electric supply cables 4 and irons 1 may be utilized.

Figure 4:
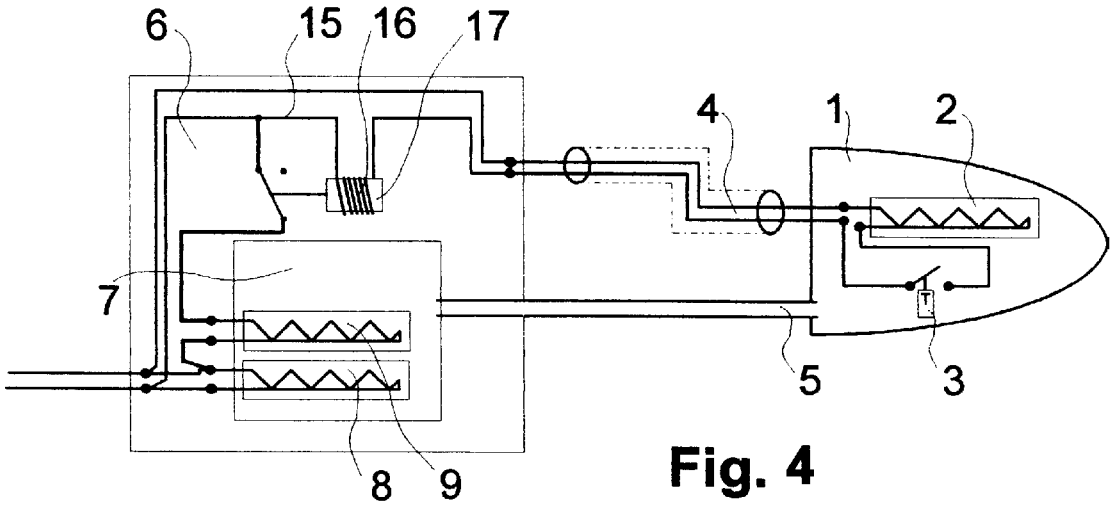

The embodiment illustrated in FIG. 4 comprises a current relay 17 having a relay solenoid 16 through which the iron heater current 15 directly flows and thus switches the relay 17 to close the additional heater circuit 9 for the steam generator 7 when the thermostat 3 opens the iron heater circuit 2. In case of a line voltage of 100V, the current intensity is approximately 8A, while in the case of a line voltage of 220/230V, the current intensity is still as high as 3.5A, with which suitable relay solenoids may be operated without difficulty.

All the above-described embodiments ensure that in an ironing station which is composed of an iron and a separate steam generating unit would, in a cleaning installation, operate the steam generator with the maximum power in case the iron is not connected.

It will be understood that the above description of the present invention is susceptible to various modifications, changes and adaptations, and the same are intended to be comprehended within the meaning and range of equivalents of the appended claims.

What is claimed is:

1. A steam ironing station comprising (a) a steam iron;

(b) a steam generator;

(c) means for introducing steam from said steam generator into said steam iron;

(d) an iron heater disposed in said iron and having an iron heater circuit connectable to a line voltage;

(e) temperature responsive means for opening said iron heater circuit when a predetermined ironing temperature is reached;

(f) a steam generator heater disposed in said steam generator and having first and second steam heater circuits connectable to the line voltage; an electric power supplied simultaneously by said iron heater circuit and by said first steam heater circuit to said steam ironing station having a maximum value of a rated power of the line voltage and an electric power supplied solely by said second steam heater circuit to said steam ironing station having a maximum value of the rated power and a greater value than the power supplied by said first steam heater circuit; and (g) switching means for placing said second steam heater circuit in a closed state solely when said iron heater circuit is in an open state.

2. The steam ironing station as defined in claim 1, further comprising an additional steam heater circuit; said first steam heater circuit and said additional heater circuit together constituting said second steam heater circuit.

3. The steam ironing station as defined in claim 1, wherein said temperature responsive means is a thermostat; further comprising a relay for controlling said second steam heater circuit and a conductor extending from said iron heater circuit to said relay for transmitting to said relay a signal representing the open state of said iron heater circuit for operating said relay to place said second steam heater circuit into said closed state when said iron heater circuit is placed into said open state.

4. The steam ironing station as defined in claim 1, further comprising a relay for controlling said second steam heater circuit, and a sensor connected to said relay and responding to an electromagnetic field generated by a current flow through said iron heater circuit for operating said relay to place said second steam heater circuit into said closed state when said iron heater circuit is placed into said open state.

5. The steam ironing station as defined in claim 1, further comprising a relay for controlling said second steam heater circuit; said relay including a solenoid connected in said iron heater circuit and being energized by a current flowing through said iron heater circuit in the closed state thereof; said relay being arranged for placing said second steam heater circuit into said closed state when said iron heater circuit is placed into said open state.

6. The steam ironing station as defined in claim 1, wherein said temperature responsive means includes a switch having a first position in which said switch closes said iron heater circuit and opens said second steam heater circuit and a second position in which said switch, when said predetermined temperature is reached, opens said iron heater circuit and closes said second steam heater circuit.

* * * * *